US009609965B2

(12) United States Patent
Cai

(10) Patent No.: US 9,609,965 B2
(45) Date of Patent: Apr. 4, 2017

(54) FOOD PLATE

(71) Applicant: Alice Cai, Fayetteville, AR (US)

(72) Inventor: Alice Cai, Fayetteville, AR (US)

( * ) Notice: Subject to any disclaimer, the term of this patent is extended or adjusted under 35 U.S.C. 154(b) by 0 days.

(21) Appl. No.: 14/975,858

(22) Filed: Dec. 21, 2015

(65) Prior Publication Data

US 2016/0106240 A1 Apr. 21, 2016

Related U.S. Application Data

(63) Continuation-in-part of application No. 14/221,670, filed on Mar. 21, 2014, now abandoned.

(60) Provisional application No. 61/905,977, filed on Nov. 19, 2013.

(51) Int. Cl.
*A47G 19/02* (2006.01)
*A47G 19/06* (2006.01)
*A47G 19/03* (2006.01)

(52) U.S. Cl.
CPC ..... *A47G 19/065* (2013.01); *A47G 19/06* (2013.01); *A47G 19/03* (2013.01)

(58) Field of Classification Search
CPC . A63F 2001/025; A47G 19/02; A47G 19/025; A47G 19/03
See application file for complete search history.

(56) References Cited

U.S. PATENT DOCUMENTS 3,401,858 A * 9/1968 White ..... A47G 19/06 206/561
4,966,297 A * 10/1990 Doty ..... A47G 19/06 206/564
D484,746 S * 1/2004 McMullin ..... D7/553.6
7,093,832 B2 * 8/2006 Parker ..... A47G 19/025 273/236
8,348,091 B1 * 1/2013 Zox ..... A47G 19/06 206/564

* cited by examiner

*Primary Examiner* — Anthony Stashick
*Assistant Examiner* — Mollie Impink

(57) ABSTRACT

The present invention is a food plate that has weakening lines near the edge of the plate. The weakening lines define removable areas on the food plate. A person can use the present invention as a traditional food plate to hold a plate of food. He or she also can use the unique features of the present invention. By detaching the removable sections defined by the weakening lines, a user can create recesses on the food plate. The user can then put his or her index finger and thumb into the recesses to hold a drink on the top surface of the food plate, and use his or her other fingers to support the food plate from the bottom of the plate.

3 Claims, 8 Drawing Sheets

FIG. 6A
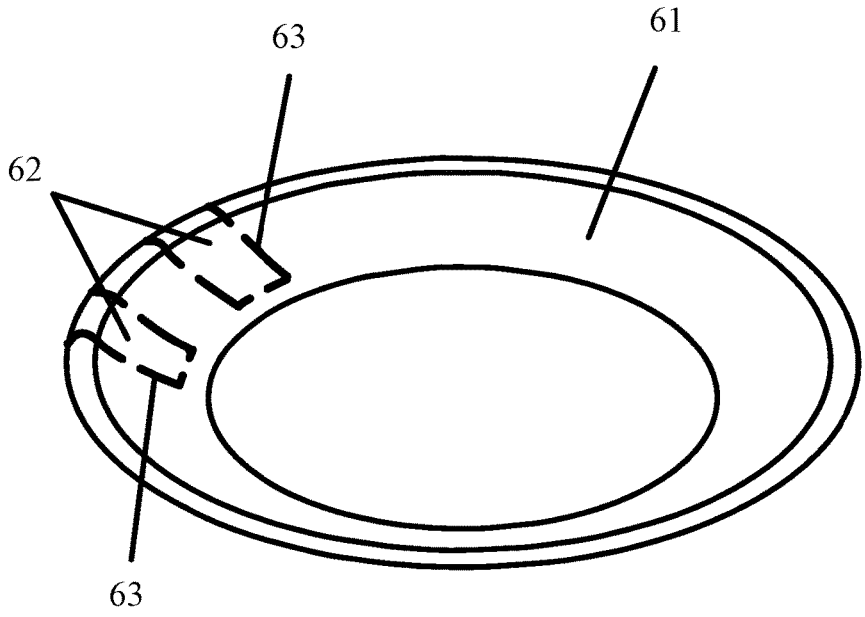
FIG. 6B
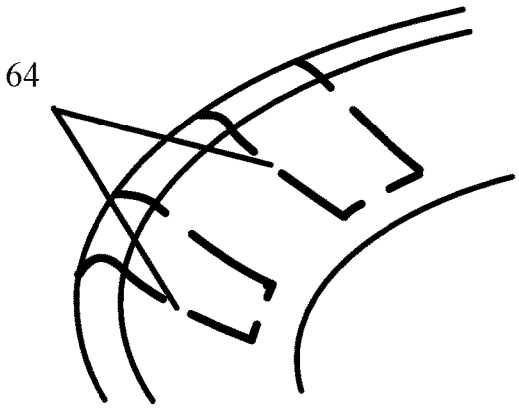
FIG. 6

FOOD PLATE

CROSS-REFERENCE TO RELATED APPLICATION

This application is a continuation of U.S. patent application Ser. No. 14/221,670, filed on Mar. 21, 2014. The U.S. patent application Ser. No. 14/221,670 claims the benefit of U.S. provisional application No. 61/905,977, filed on Nov. 19, 2013.

BACKGROUND OF THE INVENTION

1. Field of the Invention

The present invention relates generally to a food plate and more specifically relates to a food plate that enables a user to simultaneously hold a plate of food and drink with one hand, leaving the other hand free.

2. Description of the Related Art

In many social events such as parties and picnics, it is quite common that, during a meal, a person walks around to socialize with other people. He/she usually holds a plate of food with one hand and a fork or spoon with another hand, which makes it difficult for him/her to carry a drink along with a plate of food. Not being able to carry both a plate of food and a drink during social events is a long-standing problem.

Many people have tried to solve the problem through various inventions. For example, in the US patent (U.S. Pat. No. 4,938,373), McKee disclosed a plate having a central area configured to hold and support a drink container. In the US patent (U.S. Pat. No. 5,695,052), Damato reported a food plate comprising an adaptable cavity on a food plate. The cavity is used to hold a drink container. In the US patent (U.S. Pat. No. 6,138,860) issued to Comeaux, a plate and glass assembly is invented to enable a person to hold both the plate and glass single handed. In the US patent (U.S. Pat. No. 6,425,480), Krueger reported a portable device that combines a drink container and food tray. In addition to many issued patents, there are several commercial products addressing the problem in the market.

However, these inventions and products have weaknesses. Some of them increase manufacturing costs and some of them are difficult or awkward to use. The present invention solves the above problem by creating removable sections near the edge of a food plate. The removable sections are connected with the rest of the food plate through perforated lines or other kind of weakening lines. Once the removable sections are detached from the plate, recesses appear near the edge of the plate. A user can insert his/her fingers into the recesses and simultaneously hold the plate and a drink placed on the top of the plate with one hand.

Although some inventors have used perforation to create removable portions on a food plate, the purposes of their inventions are different from the present invention. For example, in US patent titled Conversation Generator (U.S. Pat. No. 7,093,832), Mary Louise Parker uses perforated lines to create removable tabs on a food plate. Conversation topics are written on the back side of the tabs. A user can use the written topics to initiate conversations during parties. In the US patent titled Portion Access Pie Plate (U.S. Pat. No. 3,580,484), the inventor uses lines of weakening to define a detachable portion of a pie plate from the rest of the plate for the purpose of easily taking a pie out of the plate. In the US patent titled Condiment-carrying Lid (U.S. Pat. No. 6,209,748 B1), Lee Wayne Dunbar creates a perforated drinking section along an edge of a cup lid, allowing a user to inserting additives in the drink. In the US patent application titled Interlocking Storage Carton (US Patent Application No. 20030006273), Micah Tsern invented an interlocking carton which can be easily assembled for storing food.

The above mentioned patents utilize weakening lines to define detachable sections on a surface, but the purposes of these inventions are to solve different problems from the present invention does. Therefore, there is no prior art for the present invention.

BRIEF SUMMARY OF THE INVENTION

The present invention enables a person to hold simultaneously both a plate of food and a drink with one hand, leaving the other hand free. The appearance of the present invention is similar to a traditional food plate, except there are some weakening lines that define removable sections on the food plate. If a person wants to use the present invention to hold simultaneously a plate of food and drink with one hand, all he/she needs to do is to detach the removable portions to create recesses on the plate. Then the user puts his/her index finger and thumb into the recesses to hold a drink on the top surface of the plate and uses other fingers to support the food plate from bottom.

BRIEF DESCRIPTION OF THE DRAWINGS

FIG. 6 is a perspective view of another preferred embodiment of the present invention.

DETAILED DESCRIPTION OF THE INVENTION

Embodiment I

Figure 1:
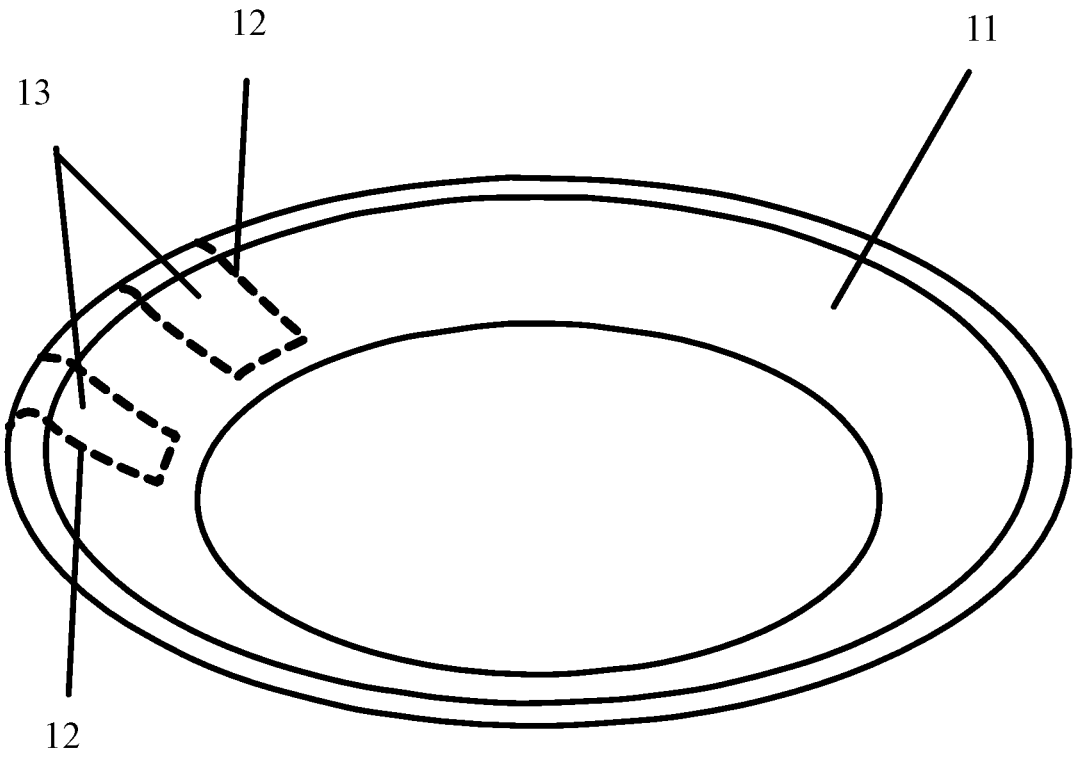
FIG. 1 is a perspective view of a preferred embodiment of the present invention. It shows a food plate having perforated lines near its edge.

FIG. 1 is a perspective view of a preferred embodiment of the present invention. There are two removable sections 13 on the edge of a food plate 11. The removable sections 13 are defined by perforated lines 12 on the plate 11. The food plate 11 can be used as a traditional food plate.

Figure 2:
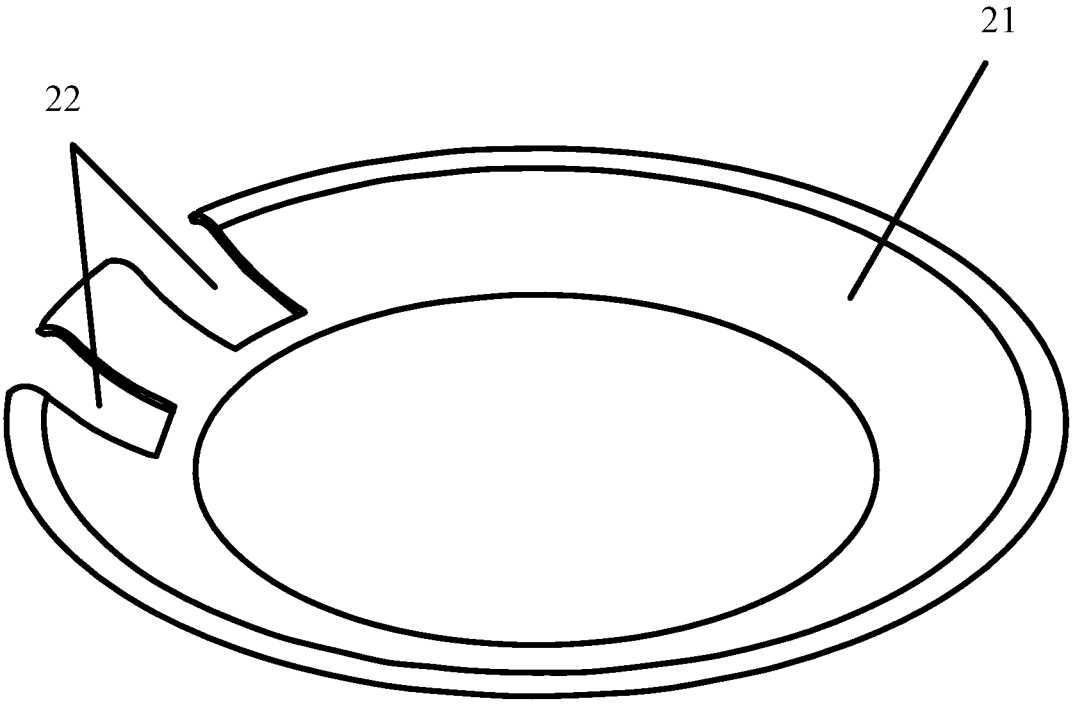
FIG. 2 is a perspective view of a preferred embodiment of the present invention. It shows two recesses at the edge of a food plate.

FIG. 2 is a perspective view of a preferred embodiment of the present invention. It shows two recesses 22 appearing at the edge of the food plate 21 after the removable sections 13 (FIG. 1) are detached from the plate 11 (FIG. 1). The sizes of the recesses 22 are large enough to allow a user to insert his/her index finger and thumb into the recesses 22. After the removable sections 13 (FIG. 1) are detached from the plate 11 (FIG. 1), a user can use the food plate 21 to simultaneously hold a drink as well as food.

Figure 3:
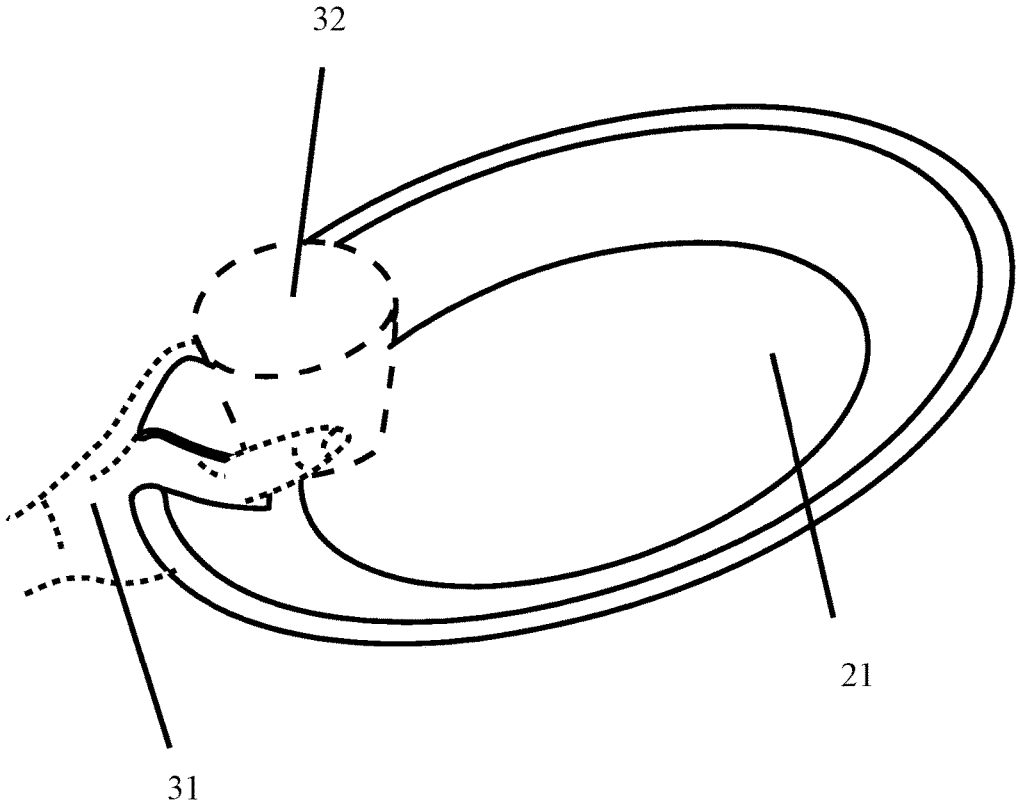
FIG. 3 is a perspective view of a preferred embodiment of the present invention. It illustrates how to use the present invention.

FIG. 3 shows how to use the food plate 21. The hand and cup drawn in dash lines in the figure are not part of the invention. FIG. 3 shows that once the removable sections 13 (FIG. 1) are removed from the plate 11 (FIG. 1), a person can put his/her fingers through the recesses 22 (FIG. 2) and hold both the plate 21 and the cup with one hand.

Embodiment II

Figure 4:
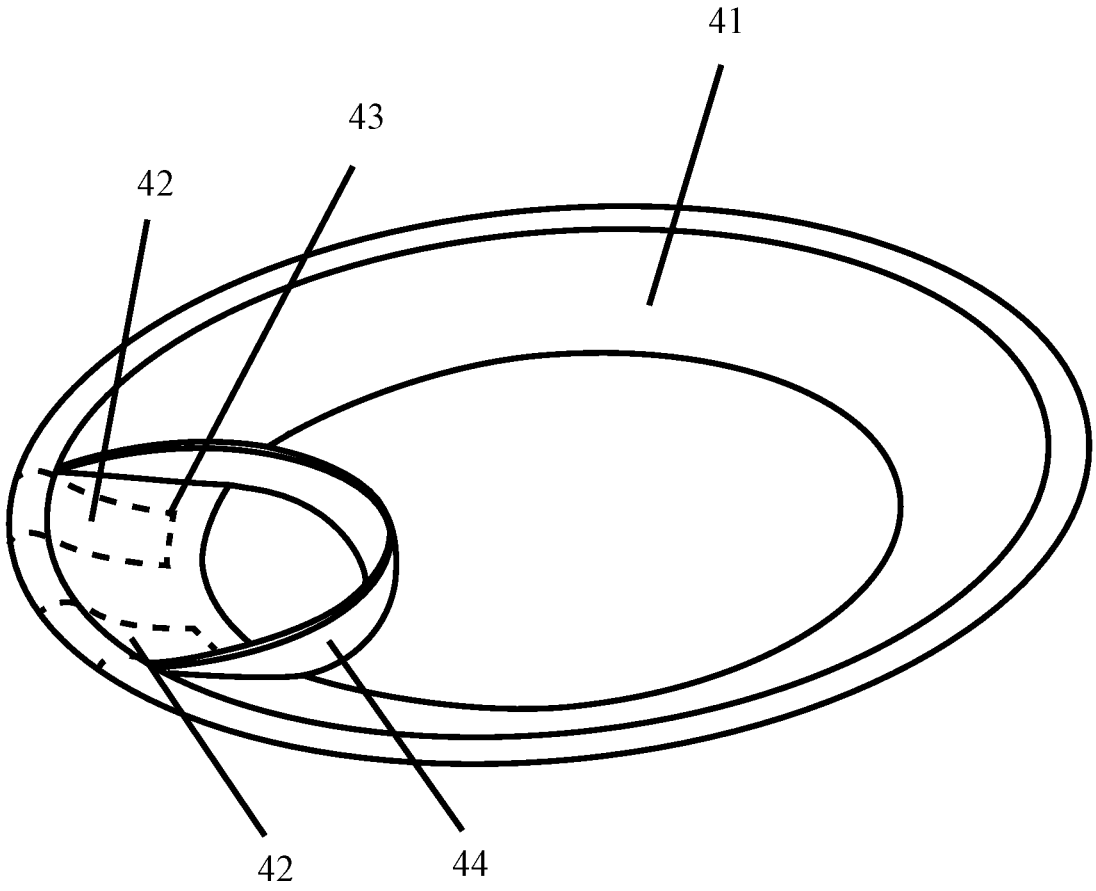
FIG. 4 is a perspective view of another preferred embodiment of the present invention. It shows perforated lines and a curved ridge near the edge of a food plate.

FIG. 4 is a perspective view of another preferred embodiment of the present invention. On the food plate 41, there is a curved ridge 44 and two removable portions 42 on the concave side of the ridge 44. The size and locations of the removable portions 42 are defined by perforated lines 43. The plate 41 can be used as a traditional food plate. The function of ridge 44 is to divide the food plate 41 into two sections.

Figure 5:
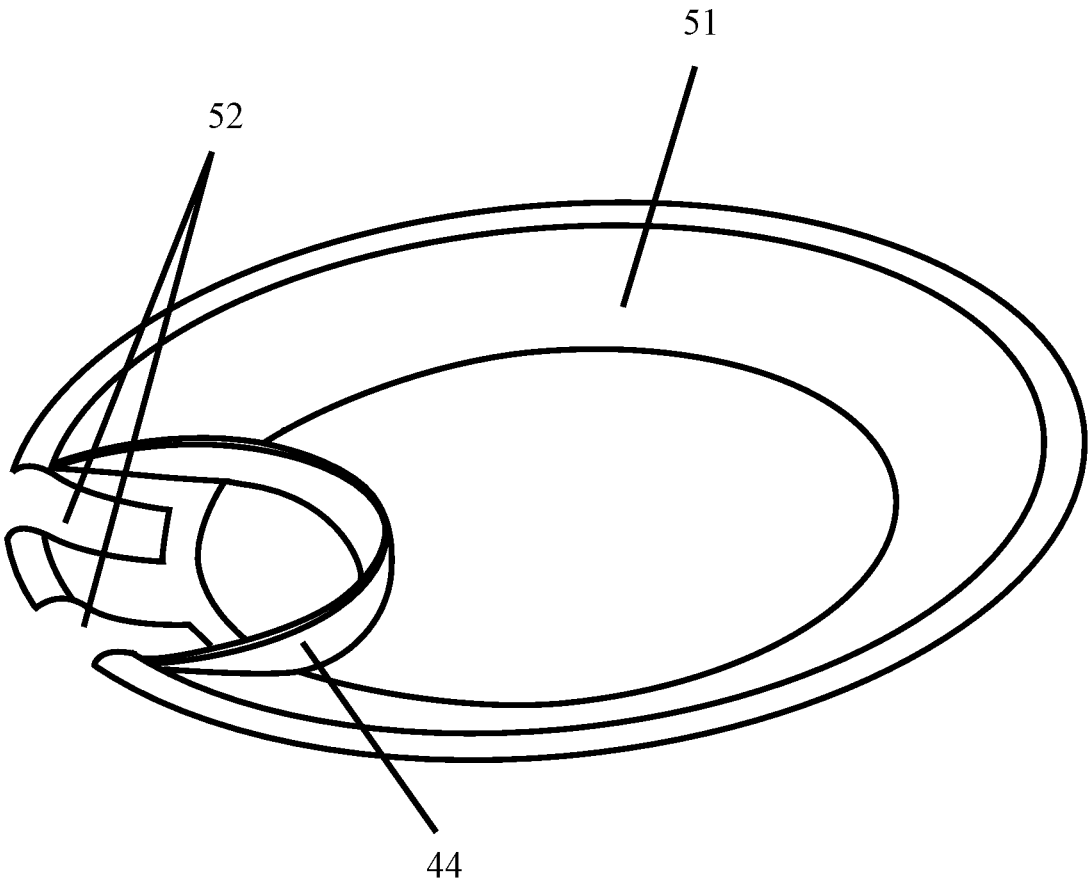
FIG. 5 is a perspective view of another preferred embodiment of the present invention. It shows two recesses and a curved ridge near the edge of a food plate.

FIG. 5 is a perspective view of the present invention. Two recesses 52 appear at the edge of the food plate 51 after the removable sections 42 (FIG. 4) are detached from the plate 41 (FIG. 4). The sizes of the recesses 52 are large enough to allow a user to insert his/her index finger and thumb into the recesses 52. To simultaneously hold a plate of food and a drink, a user can insert his/her index finger and thumb into the recesses 52. The user can then grab/hold the drink that is placed on top of the plate 52 and surrounded by the curved ridge 44.

The above embodiments are presented for illustrative purposes and are not intended to limit the scope of the present invention. Other modifications can be undertaken by a skilled artisan without departing from the spirit and scope of this invention.

For example, the weakening lines 13 in FIG. 1 do not have to be perforated lines. They can be incomplete cuts 63 as shown in FIG. 6A. In FIG. 6A, the removable sections 62 are defined by incomplete cuts 63. FIG. 6B shows enlarged drawing of the cuts. The white parts 64 in the incomplete cuts 63 keep the removable sections 62 remaining on the plate 61.

Figure 7:
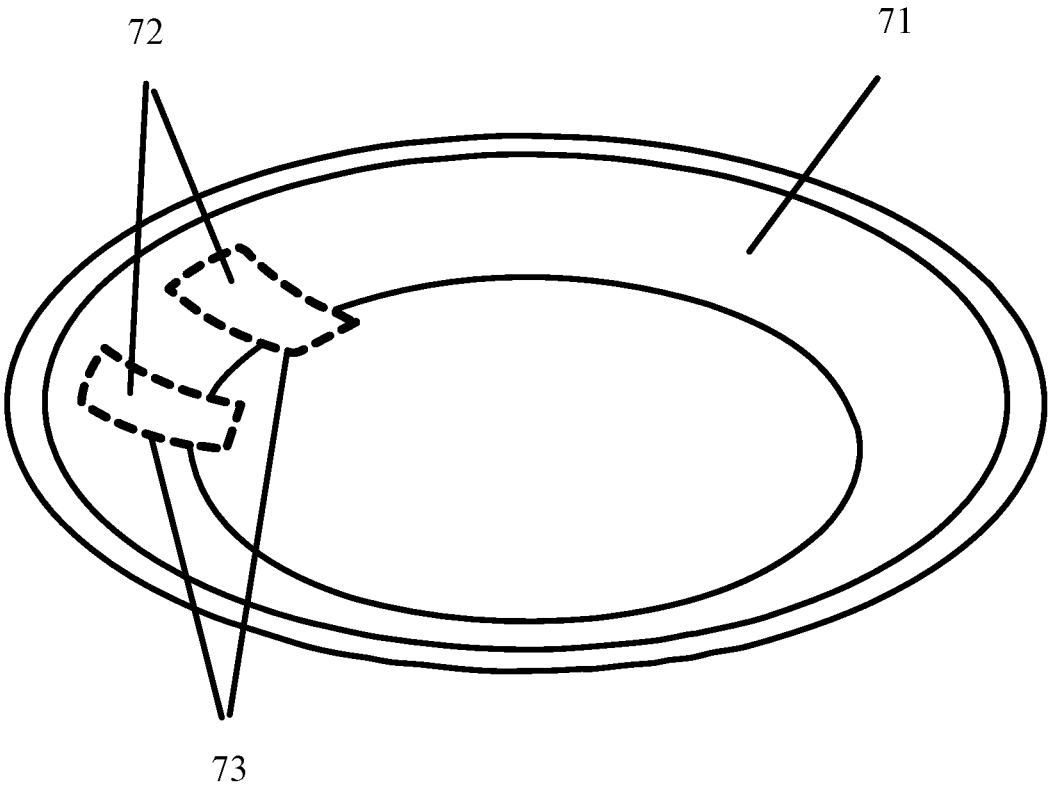
FIG. 7 is a perspective view of another preferred embodiment of the present invention. It shows two removable portions are defined by perforated lines.

The removable sections of a plate do not have to be at the edge of the plate. FIG. 7 shows that the removable sections 72 defined by perforated lines 73 are near the edge of a food plate 71. In addition, the number of removable sections does not have to be two.

Figure 8:
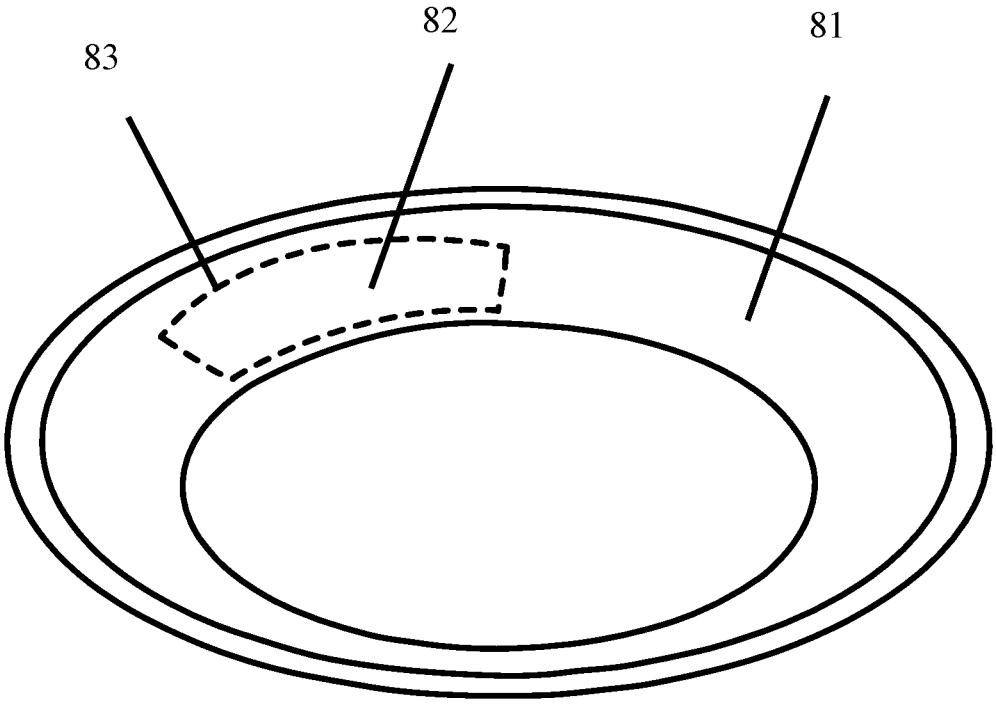
FIG. 8 is another perspective view of a preferred embodiment of the present invention.

FIG. 8 shows a food plate 81 that has a large removable section 82 defined by perforated lines 83 near the edge of the plate 81. The removable section 82 is large enough for a person to insert both his/her index finger and thumb through the cavity created by detaching the removable section 82.

There can be many other variations too. For example, in the present invention, the shape, number, and location of the removable sections do not have to be the same as what is shown in FIGS. 1 through 8. The shape of the removable piece can be regular or irregular; there can be one or more removable pieces; the location of the removable sections can be at the edge, near the edge, or any other location on the plate.

I claim:

1. A food plate for a person to simultaneously hold both a plate of food and a drink with one hand, comprising consisting of:

a substantially flat surface for holding food;

a raised lip around the perimeter of said substantially flat surface for preventing food from falling off said substantially flat surface;

two removable portions at or near the perimeter of said food plate;

weakening lines that define the shapes, sizes, and locations of said removable portions, wherein two cavities is are created when said removable portions defined by said weakening lines are completely detached from said food plate;

wherein said cavities are capable of accommodating an index finger and a thumb of a hand of a user such that the user is capable of inserting the index finger and the thumb into one of each said cavities.

2. The invention of claim 1, wherein said weakening lines that define said removable portions are perforated lines or incomplete cuts.

3. The invention of claim 1, wherein the shapes of said removable portions are regular or irregular shaped.

* * * * *